US010015605B2

(12) United States Patent
Flynn et al.

(10) Patent No.: US 10,015,605 B2
(45) Date of Patent: Jul. 3, 2018

(54) FITTING A BILATERAL HEARING PROSTHESIS SYSTEM

(71) Applicant: Cochlear Limited, Macquarie University, NSW (AU)

(72) Inventors: Mark C. Flynn, Gothenburg (SE); Martin Hillbratt, Lindome (SE)

(73) Assignee: Cochlear Limited, Macquarie University, NSW (AU)

( * ) Notice: Subject to any disclaimer, the term of this patent is extended or adjusted under 35 U.S.C. 154(b) by 0 days.

(21) Appl. No.: 15/453,370

(22) Filed: Mar. 8, 2017

(65) Prior Publication Data

US 2017/0180895 A1 Jun. 22, 2017

Related U.S. Application Data

(63) Continuation of application No. 13/915,424, filed on Jun. 11, 2013.

(Continued)

(51) Int. Cl.
*H04R 25/00* (2006.01)
*H04R 3/02* (2006.01)

(52) U.S. Cl.
CPC ..... *H04R 25/70* (2013.01); *H04R 25/35* (2013.01); *H04R 25/453* (2013.01);

(Continued)

(58) Field of Classification Search
CPC ..... H04R 25/70; H04R 25/453; H04R 25/35; H04R 25/552; H04R 2460/13; H04R 25/45; H04R 3/02

(Continued)

(56) References Cited

U.S. PATENT DOCUMENTS 4,531,229 A 7/1985 Coulter
5,267,321 A 11/1993 Langberg (Continued)

FOREIGN PATENT DOCUMENTS

WO 2010/094812 A2 8/2010

OTHER PUBLICATIONS

Examination Report No. 1 in counterpart Australian Application No. 2014229302, dated Feb. 9, 2017, 4 pages.

(Continued)

*Primary Examiner* — Oyesola C Ojo
(74) *Attorney, Agent, or Firm* — Edell, Shapiro & Finnan, LLC

(57) ABSTRACT

A hearing prosthesis system includes a processor arranged to communicate a stimulation signal to a vibration stimulator of a first hearing prosthesis. The processor receives an indication of a measured input signal from a first transducer of a second hearing prosthesis. A processor calculates a feedback associated with the stimulation. The processor may also be further configured to adjust a gain table or an input to a feedback reduction algorithm in response to the calculated feedback. Additionally, the processor of the hearing prosthesis system may also be arranged to communicate a second stimulation signal to a vibration stimulator of the second hearing prosthesis. The processor receives an indication of a measured input signal from the first hearing prosthesis. Further, the processor calculates a second feedback associated with the second stimulation.

20 Claims, 7 Drawing Sheets

Related U.S. Application Data

(60) Provisional application No. 61/787,991, filed on Mar. 15, 2013.

(52) U.S. Cl.
CPC ..... *H04R 25/552* (2013.01); *H04R 3/02* (2013.01); *H04R 25/45* (2013.01); *H04R 2460/13* (2013.01)

(58) Field of Classification Search
USPC ..... 381/318
See application file for complete search history.

(56) References Cited

U.S. PATENT DOCUMENTS 5,479,522 A 12/1995 Lindemann et al.
5,553,151 A 9/1996 Goldberg
5,991,419 A * 11/1999 Brander ..... H04R 25/552 381/312
6,353,671 B1 3/2002 Kandel et al.
6,434,246 B1 8/2002 Kates et al.
6,643,378 B2 * 11/2003 Schumaier ..... H04R 25/606 381/318
7,630,507 B2 12/2009 Kates
7,676,372 B1 3/2010 Oba
7,953,237 B2 5/2011 Sporer
8,121,321 B2 * 2/2012 Iwano ..... H04R 25/43 381/23.1
8,687,832 B2 4/2014 Elmedyb et al.
8,731,205 B2 * 5/2014 Parker ..... H04R 25/70 381/59
9,596,534 B2 * 3/2017 Heiman ..... H04R 1/46
2002/0094099 A1 7/2002 Kandel et al.
2002/0191805 A1 12/2002 Hagen et al.
2003/0228019 A1 * 12/2003 Eichler ..... H04R 1/1008 381/71.8
2005/0141733 A1 6/2005 Blarney et al.
2006/0093172 A1 5/2006 Ludvigsen et al.
2006/0093173 A1 * 5/2006 Hamacher ..... H04R 25/453 381/317
2007/0076910 A1 * 4/2007 Sporer ..... H04R 25/453 381/312
2009/0030484 A1 * 1/2009 Chambers ..... A61N 1/36032 607/57
2009/0154743 A1 6/2009 Lundh et al.
2009/0196445 A1 8/2009 Elmedyb et al.
2009/0304210 A1 * 12/2009 Weisman ..... H04R 1/1083 381/151
2010/0020995 A1 * 1/2010 Elmedyb ..... H04R 25/453 381/318
2010/0060384 A1 3/2010 Taniguchi et al.
2011/0222630 A1 * 9/2011 Suzuki ..... H03F 1/3247 375/297
2011/0228960 A1 * 9/2011 Arndt ..... H04R 25/453 381/313
2011/0293105 A1 * 12/2011 Arie ..... H04M 1/05 381/71.11
2012/0275629 A1 11/2012 Meskens et al.
2013/0156202 A1 * 6/2013 Hamacher ..... H04R 25/453 381/23.1
2013/0188796 A1 7/2013 Kristensen et al.
2013/0308804 A1 11/2013 Meskens

OTHER PUBLICATIONS

Search Report and Written Opinion in International Application No. PCT/IB2014/059676, dated Aug. 1, 2014.
Extended European Search Report in European Application No. 14764022.1, dated Aug. 19, 2016, 8 pages.
Examination Report in corresponding European Application No. 14764022.1, dated Aug. 29, 2017, 7 pages.

* cited by examiner

FITTING A BILATERAL HEARING PROSTHESIS SYSTEM

REFERENCE TO RELATED APPLICATIONS

The present application is a continuation of U.S. application Ser. No. 13/915,424, filed Jun. 11, 2013, which in turn claims priority to U.S. Provisional Patent Application Ser. No. 61/787,991, filed in the United States Patent and Trademark Office on Mar. 15, 2013. The entire contents of these applications are incorporated by reference herein.

BACKGROUND

Various types of hearing prostheses provide people having different types of hearing loss with the ability to perceive sound. Hearing loss may be conductive, sensorineural, or some combination of both conductive and sensorineural. Conductive hearing loss typically results from a dysfunction in any of the mechanisms that ordinarily conduct sound waves through the outer ear, the eardrum, or the bones of the middle ear. Sensorineural hearing loss typically results from a dysfunction in the inner ear, including the cochlea, where sound vibrations are converted into neural signals, or any other part of the ear, auditory nerve, or brain that processes the neural signals.

People with some forms of hearing loss may benefit from hearing prostheses, such as acoustic hearing aids or vibration-based hearing aids. An acoustic hearing aid typically includes a small microphone to detect sound, an amplifier to amplify certain portions of the detected sound, and a small speaker to transmit the amplified sound into the person's ear. Vibration-based hearing aids typically include a small microphone to detect sound, and a vibration mechanism to apply vibrations corresponding to the detected sound to a person's bone, thereby causing vibrations in the person's inner ear, thus bypassing the person's auditory canal and middle ear. Vibration-based hearing aids include bone anchored hearing aids, direct acoustic cochlear devices, or other vibration-based devices (e.g. bone-conduction hearing glasses and vibration-based behind-the-ear prostheses), and may be partially or totally implanted or simply in external contact with a suitable body part of the person.

One type of bone conduction device utilizes a surgically-implanted mechanism to transmit sound via direct vibrations of an implant recipient's skull. A component of the bone conduction device detects sound waves, which are converted into a series of stimulation signals delivered to the implant recipient's skull bones via an electromechanical stimulator (e.g., a mechanical actuator).

By providing stimulation to the recipient's skull, the bone conduction device effectively bypasses the recipient's middle ear and auditory canal, which is advantageous for recipients having medical conditions that affect the middle or outer ear. The vibrations of the recipient's skull bones cause fluid motion within the recipient's cochlea, thereby enabling the recipient to perceive sound based on the vibrations. Similarly, a direct acoustic cochlear device typically utilizes a surgically-implanted mechanism to transmit sound by directly moving the ossicular chain of the recipient, which causes fluid motion within the recipient's cochlea. Other non-surgical vibration-based hearing aids use similar vibration mechanisms to transmit sound via direct vibration of a recipient's teeth or other cranial or facial bones.

Each type of hearing prosthesis has an associated sound processor. In some types of hearing prostheses, the sound processor amplifies sounds received by the prosthesis. However, other types of hearing prosthesis include a more advanced processor. For example, some processors are programmable and include advanced signal processing functions (e.g., noise reduction functions) and speech algorithms.

In some hearing prosthesis systems, prostheses are present on both the left and right sides of the recipient. In such a bilateral system, the left prosthesis provides audio corresponding to the left ear and the right prosthesis provides audio corresponding to the right ear. The two prostheses may operate independently of each other. However, in some systems, the two prostheses can communicate with one another and transfer the captured audio or data from the left ear prosthesis to the right ear prosthesis and vice versa. Yet other systems may include more than two prostheses in communication with one another.

Some example bilateral hearing prosthesis systems include a vibration mechanism or stimulator in each prosthesis that outputs an amplified captured sound as mechanical vibrations. In these systems, a first vibration-based hearing prosthesis is coupled to the left side of a recipient's head and a second vibration-based hearing prosthesis is coupled to the right side of a recipient's head. Feedback occurs when a portion of the sound captured by the microphone associated with one of the vibration-based hearing prostheses includes either (i) the mechanical vibrations produced by the vibration stimulator of the respective vibration-based hearing prosthesis or (ii) the mechanical vibrations produced by the vibration stimulator of the other vibration-based hearing prosthesis. When the microphone of one of the prostheses captures the mechanical vibrations from either of the two prostheses and then the respective prosthesis produces an output based on those vibrations, an undesirable acoustic feedback results.

For example, the left vibration-based hearing prosthesis receives a sound and responsively provides a stimulus to the recipient. The right vibration-based hearing prosthesis may receive both (i) a second sound and (ii) a portion of the stimulus provided by the left vibration-based hearing prosthesis. The right vibration-based hearing prosthesis then responsively creates a second stimulus based on the combination of both (i) the second sound and (ii) the portion of the stimulus provided to the recipient by the left vibration-based hearing prosthesis and captured by the microphone of the right vibration-based hearing prosthesis. The feedback loop may continue if the left vibration-based hearing prosthesis then receives a portion of the second stimulus (created by the right vibration-based hearing prosthesis). When fitting a bilateral system, the conventional practice is for the audiologist to reduce the prescribed gain for each unit by around 3 dB, to prevent the recipient from hearing excessive loudness.

SUMMARY

In a first aspect of the present disclosure, a bilateral hearing prosthesis system includes both a first and second hearing prosthesis. The bilateral hearing prosthesis system also includes a processor arranged to communicate a stimulation signal to a vibration stimulator of the first hearing prosthesis. The processor is also arranged to receive an indication of an input signal measured by the second hearing prosthesis. Further, the processor calculates a feedback associated with the stimulation signal communicated to the first hearing prosthesis based on the indication of the input signal measured by the second hearing prosthesis. In this aspect, the first vibration stimulator is located within a first hearing prosthesis, while a first vibration sensor is located within a second hearing prosthesis. The first vibration sensor is configured to convert a vibration at the second hearing prosthesis into an electrical signal. This electrical signal from the vibration sensor is indicative of feedback. In some embodiments, the processor is further configured to adjust a gain in response to the feedback.

Additionally, in various embodiments, the processor of the hearing prosthesis system is arranged to communicate a second stimulation signal to a vibration stimulator of the second hearing prosthesis. The processor is also arranged to receive an indication of an input signal measured by the first hearing prosthesis. Further, the processor calculates a second feedback associated with the second stimulation signal communicated to the second hearing prosthesis based on the indication of the input signal measured by the first hearing prosthesis. In this aspect, the second vibration stimulator is located within a second hearing prosthesis and a second vibration sensor is located within the first hearing prosthesis. The second vibration sensor is configured to convert a vibration at the first hearing prosthesis into an electrical signal. This electrical signal from the vibration sensor is indicative of feedback. Some embodiments include the processor also adjusting a maximum gain (or other stimulation parameter) in response to the second feedback. In some further embodiments, the processor is also configured to communicate the first stimulation signal and the second stimulation signal at approximately the same time.

In a second aspect of the present disclosure, a method is provided. The method includes providing a first vibration from a first transducer to a first location of a recipient. The first vibration is based on a first calibration signal. The method also includes measuring a first input signal with a first microphone at a second location of the recipient. The first input signal is based on the first vibration, as conducted from the first location to the second location. The method further includes determining a first feedback based on the measured first input signal. Additionally, the method includes adjusting a first parameter associated with the first transducer based on the first feedback.

In a third aspect of the present disclosure, another method is provided. This additional method includes generating a first stimulation signal with a processor and stimulating a recipient at a first location with a first stimulation. The first stimulation is based on the generated first stimulation signal. The method also includes measuring a first signal associated with the first stimulation at a second location. Moreover, the method includes calculating a first feedback based on the measured first signal at the second location. The method further includes adjusting a first stimulation parameter based on the calculated first feedback.

In a fourth aspect of the present disclosure, a hearing prosthesis system includes a first prosthesis coupled to a first location on a recipient. The first prosthesis includes an input sensor and an electromechanical stimulator configured to provide a first stimulation to the recipient. The hearing prosthesis system also includes a second prosthesis coupled to a second location on the recipient. The second prosthesis includes an input sensor and an electromechanical stimulator configured to provide a second stimulation to the recipient. The hearing prosthesis system further includes a processor communicably coupled to at least one of the first prosthesis and the second prosthesis. The processor is configured to both (i) communicate a first stimulation signal to the first prosthesis and (ii) measure a first feedback signal provided by the second prosthesis. The first prosthesis provides the first stimulation based on the first stimulation signal. Additionally, the first feedback signal is based on the first stimulation provided by the first prosthesis.

In a fifth aspect of the present disclosure, a hearing prosthesis programming system includes a processor configured to receive an indication of a first input signal from a first hearing prosthesis. The first input signal is based on a first stimulation provided by a second hearing prosthesis. The processor is further configured to determine a first feedback based on the first input signal. Additionally, the processor is configured to adjust a first parameter associated with the second hearing prosthesis based on the determined first feedback.

DETAILED DESCRIPTION

For illustration purposes, the present disclosure generally references vibration-based hearing prostheses. However, the embodiments and examples disclosed herein may be equally applicable to other types of hearing prostheses, now known or later developed. Further, some of the disclosed aspects can be applied to other acoustic devices or sound processors that are not necessarily associated with hearing prostheses.

Figure 1:
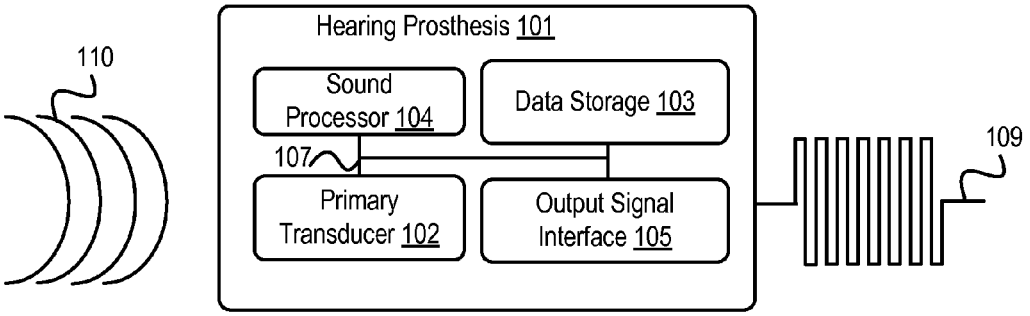
FIG. 1 is a block diagram illustrating a hearing prosthesis.

FIG. 1 is a block diagram illustrating a hearing prosthesis 101. The hearing prosthesis 101 may be a bone-anchored hearing prosthesis or other vibration-based hearing prosthesis, an acoustic hearing aid, a cochlear implant, a direct acoustic stimulation device, an auditory brain stem implant, or any other type of hearing prosthesis configured to receive and process at least one signal from an audio transducer of the prosthesis. The majority of the discussion herein relates to vibration-based hearing prosthesis systems, including bilateral hearing prosthesis systems having both a cochlear implant and a bone-conduction prosthesis.

The hearing prosthesis 101 includes a primary transducer 102, a data storage 103, a sound processor 104, and an output signal interface 105, all of which are connected directly or indirectly via circuitry 107. The hearing prosthesis 101 may have additional or fewer components than the prosthesis shown in FIG. 1 such as a secondary transducer. Additionally, the components may be arranged differently than shown in FIG. 1. For example, depending on the type and design of the hearing prosthesis, the illustrated components may be enclosed within a single operational unit or distributed across multiple operational units. Further, the components may be directly connected or connected wirelessly. For example, signals components may be communicate wirelessly via a magnetic and/or radio signal pathway. One or more additional processors, such as in a computer external to the hearing prosthesis 101, assist in making various settings for the sound processor 104, such as during a fitting of the hearing prosthesis 101 to a prosthesis recipient.

The output signal interface 105 is configured to conduct an output signal 109 produced by the hearing prosthesis 101 to the prosthesis recipient. The method by which the output signal interface 105 conducts the output signal 109 varies depending on the type of hearing prosthesis embodied by hearing prosthesis 101. In one example, for a vibration-based hearing prosthesis, the output signal interface 105 includes an electromechanical stimulator (e.g. a mechanical actuator, a piezoelectric transducer, a piezomagnetic transducer, or magnetostrictive transducer) and the output signal 109 is mechanical vibration signal. In the present example, the output signal interface 105 converts an electrical stimulation signal into physical vibrations and conducts the physical vibrations as an output signal 109 to the recipient. In operation, electrical signals supplied to the electromechanical stimulator cause the stimulator to generate mechanical vibrations that are proportional to the electrical signals.

The output signal interface 105 receives the processed signal from the sound processor 104 and generates the output signal 109 based on the processed signal. Generating the output signal 109 includes generating a stimulus as a mechanical output force in the form of a vibration. In one example, the output signal interface 105 includes an anchor system that delivers the stimulus to the user in the form of a vibration applied to a bone in the recipient's skull. The vibration causes fluid in the recipient's cochlea to move, thereby activating hair cells in the recipient's cochlea. The hair cells stimulate an auditory nerve, which allows the recipient to perceive at least a portion of a sound.

Some prosthesis recipients have a bone conduction implant mounted into the skull, to directly vibrate the skull via the bone conduction implant. In such a case, the hearing prosthesis 101 is preferably co-located with the bone conduction implant, such as in a totally or partially implanted configuration. In other examples, the bone conduction implant and the hearing prosthesis 101 are contained in a single unitary package.

The mechanical vibration signals generated by the hearing prosthesis 101 and applied to the bone conduction implant cause fluid motion in the recipient's cochlea via conduction through bones of the head. This fluid motion in the cochlea causes the recipient to experience sound sensations corresponding to the sound waves received by the transducer 102 and encoded by the processor 104.

In some examples, the sound processor 104 is located in a separate component (not shown), such as a desktop computer, a laptop computer, a tablet computing device, a mobile device such as a cellular phone, or a custom computing device. In these examples, the primary transducer 102 communicates signals to the sound processor 104 via a wired or wireless connection for processing as described herein.

In one example, the sound processor 104 processes the signal based on a gain table. The gain table is stored in the data storage 103, for example, and specifies an amplification for application to the signal. For example, the gain table specifies an amplification that for all frequencies of an input signal. The gain table may alternatively specify amplification based on functions that are more complicated. In one example, the gain table specifies a gain for application to a signal based on the frequency and/or amplitude of the signal. Typically, feedback problems limit the maximum gain for a given prosthesis. The maximum gain can also be limited by maximal supported digital gain in the digital signal processor (DSP).

The prescribed gain, on the other hand, corresponds to a gain associated with a specific prosthesis recipient. In the case of a hearing prosthesis, the prescribed gain is based on a hearing impairment of the prosthesis recipient. The prescribed gain specifies a gain for each band in a plurality of frequency bands. In one example, if the feedback is contained within a specific frequency band, the processor adjusts the gain table to reduce gain on the corresponding frequency band. In accordance with various embodiments described herein, the processor adjusts either the maximum allowable gain or the prescribed gain in response to determining feedback.

Further, the hearing prosthesis may also include a secondary transducer (not shown). The secondary transducer may be the same type of transducer as the primary transducer 102 or a different type of transducer.

In accordance with a preferred embodiment, the primary transducer 102 is a microphone and the secondary transducer is a vibration sensor. A vibration sensor may be configured to measure vibrations that are conducted from a recipient's skull to the hearing prosthesis. For example, if a recipient has two hearing prostheses coupled to his or her skull, the vibration sensor located in a second prosthesis measures a vibration conducted from the first prosthesis through the skull of the recipient.

Figure 2A:
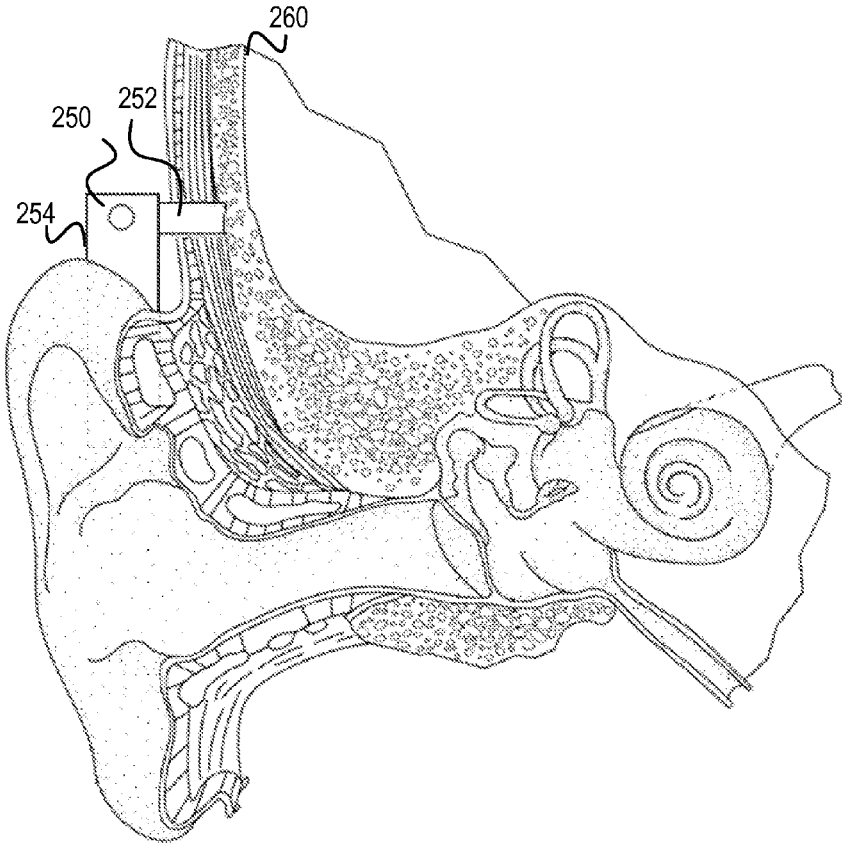
FIG. 2A is a simplified pictorial diagram illustrating a hearing prosthesis coupled to the head of a recipient.

FIG. 2A is a simplified pictorial diagram illustrating an example hearing prosthesis 250 coupled to the head of a recipient 260. In the illustrated example, the hearing prosthesis 250 is a bone conduction device having a bone conduction implant 252 that directly attaches to the skull of the recipient 260, such as via an anchor, as described above with respect to FIG. 1. The hearing prosthesis 250 of FIG. 2A includes a housing 254 that at least partially encloses one or more of the components of FIG. 1, such as the primary transducer 102 for detecting sound, the sound processing unit 104, the data storage 103, and the output signal interface 105.

Figure 2B:
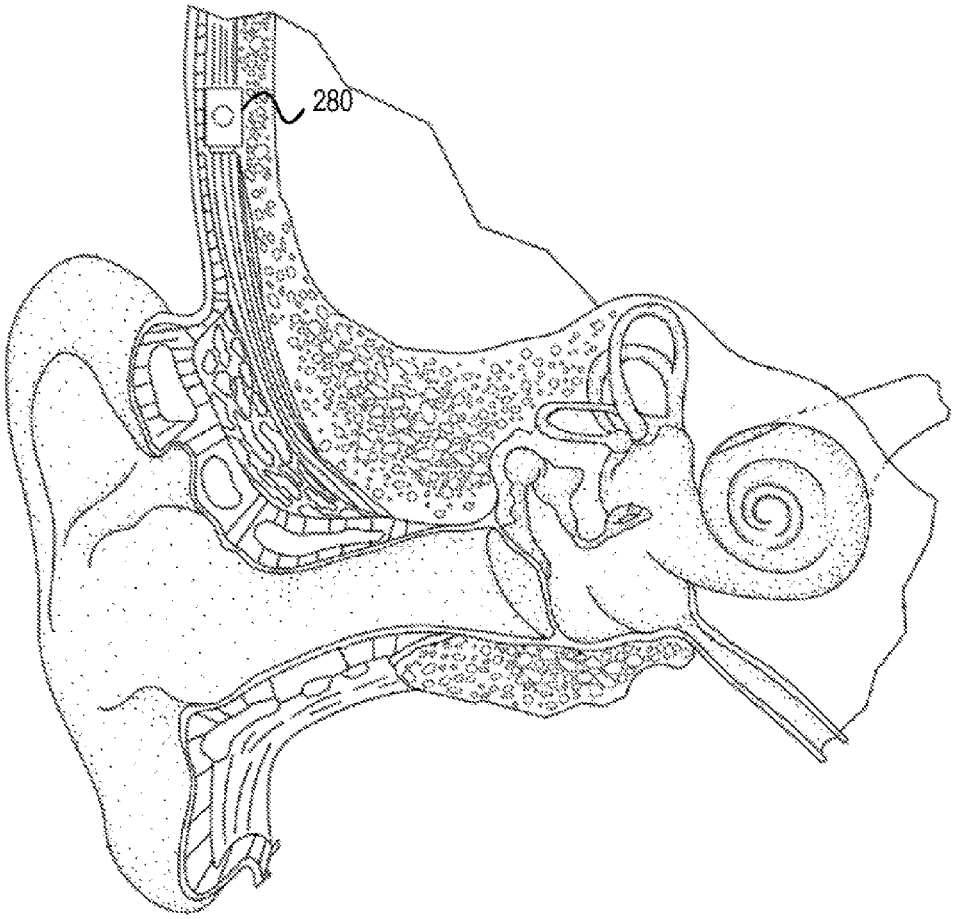
FIG. 2B is a simplified pictorial diagram illustrating a hearing prosthesis mounted within the head of a recipient.

As described with respect to FIG. 1, in some hearing prostheses systems, a recipient has a bone conduction implant 252 mounted to his or her skull. However, in other systems, the hearing prosthesis is not coupled to an implant, but rather is in external physical contact with the head of the prosthesis recipient. For example, a band or adhesive holds the hearing prosthesis in contact with the side of a recipient's head. Additionally, in some systems, as shown in FIG. 2B, the hearing prosthesis 280 is fully implanted within the recipient. In this fully implanted configuration, an input microphone (see the primary transducer 102 illustrated in FIG. 1) is designed to function when located underneath the skin of the recipient. The input microphone may include a diaphragm that experiences a deflection responsive to input audio signals. In an alternative configuration, the input microphone is not implanted with the hearing prosthesis 280, and is instead worn or located at an external location on the recipient 260.

In another example, the prosthesis is connected to a tooth (or other facial bone) of the prosthesis recipient and conducts vibrations via the teeth (or other facial bone).

Figure 3A:
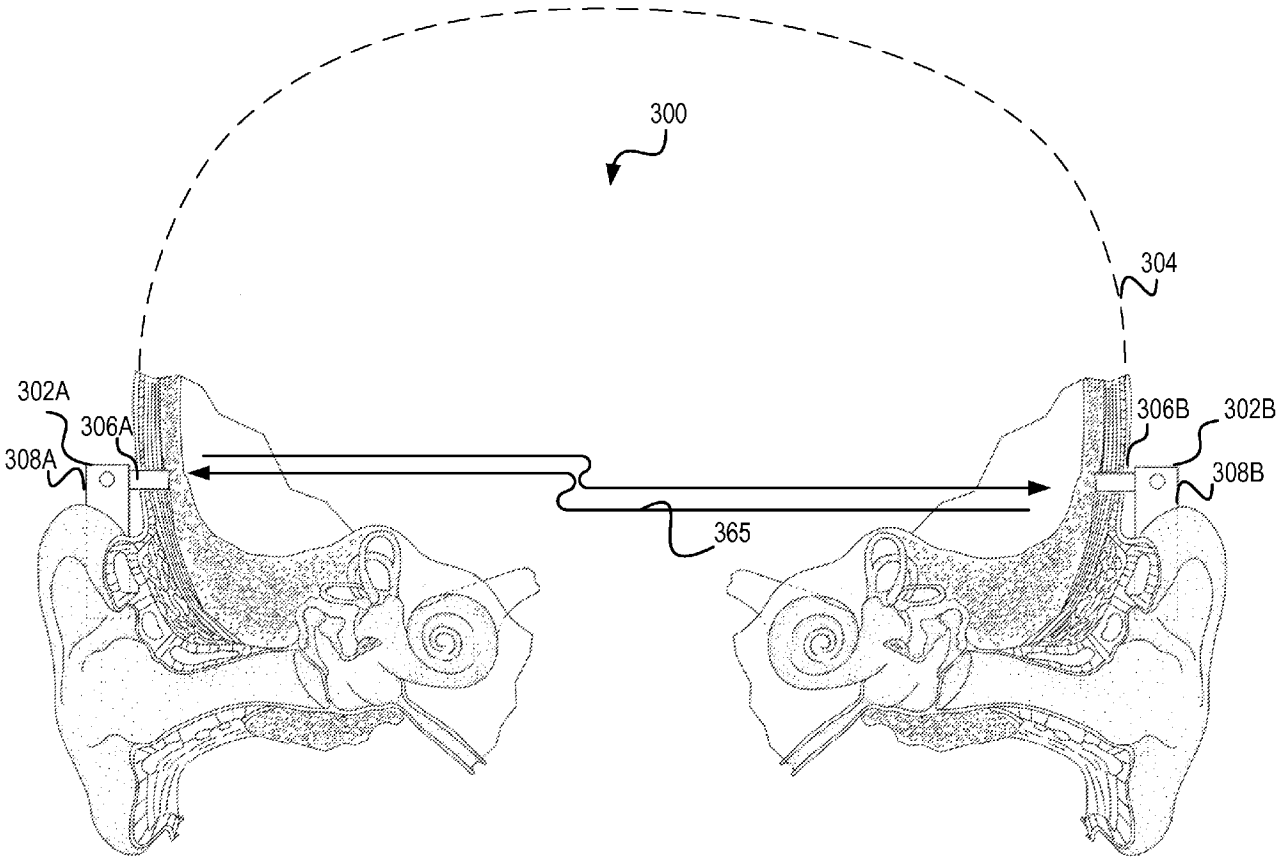
FIG. 3A is a simplified pictorial diagram illustrating a pair of hearing prostheses coupled to the head of a recipient.

FIG. 3A is a simplified pictorial diagram illustrating an example hearing prosthesis system 300 having a pair of hearing prostheses 302*a* and 302*b* coupled to the head of the recipient 304. In the example of FIG. 3A, the hearing prostheses 302*a* and 302*b* are two bone conduction devices, each directly attached to the body of the recipient 304 via respective implants 306*a* and 306*b*. Each of the hearing prostheses 302*a* and 302*b* includes a respective housing 308*a* and 308*b* to at least partially enclose one or more of the components of FIG. 1, such as the primary transducer 102 for detecting sound, the sound processing unit 104, the data storage 103, and the output signal interface 105.

During operation of hearing prostheses 302A and 302B, a first vibration-based hearing prosthesis 302A is coupled to the left side of a recipient's head and a second vibration-based hearing prosthesis 302B is coupled to the right side of a recipient's head. As previously discussed, feedback occurs when a portion of the sound captured by the microphone associated with one of the vibration-based hearing prostheses includes either (i) the sound vibrations produced by the vibration stimulator of the vibration-based hearing prosthesis with which the microphone is associated or (ii) the sound vibrations produced by the vibration stimulator of the other vibration-based hearing prosthesis. Feedback pathway 365 illustrates how the sound vibrations produced by one prosthesis are captured by the opposing prosthesis. Similarly, if a particular hearing prosthesis system includes more than two hearing prostheses, then additional feedback pathways are likely to be present.

The examples of FIGS. 2A, 2B, and 3A utilize bone-conduction vibration-based hearing prostheses. However, the disclosed methods and systems are not limited to only those shown prostheses. For example, the disclosed methods and systems may be performed with other types of hearing prostheses, such as acoustic prostheses (e.g. an acoustic hearing aid device). Further, in some embodiments, a different type of prosthesis is coupled to each respective side of the recipient's head. For example, the left side may have a vibration-based hearing prosthesis, while the right side has an acoustic hearing prosthesis. A vibration-based hearing prosthesis on the left side of the recipient's head provides a stimulation to the recipient's head. This stimulation may propagate through the skull of the recipient via feedback pathway 365 to the opposing prosthesis. The acoustic hearing prosthesis on the left side of the recipient's head may receive a portion of the stimulation as an audio input. Thus, feedback may occur between two different types of prosthesis mounted on opposite sides of the recipient's head. In accordance with embodiments described herein, this feedback may be measured by creating a stimulation with one prosthesis and measuring the signal received by the opposing prosthesis. The measured feedback can be used as data for input to a feedback reduction algorithm for one or more selected frequencies in the hearing prostheses.

Figure 3B:
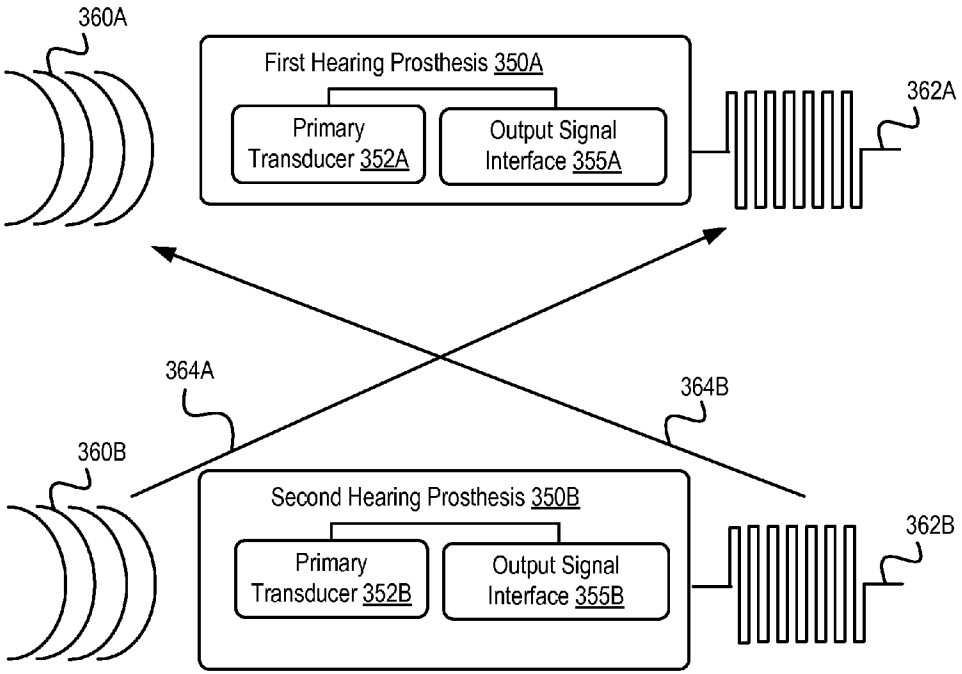
FIG. 3B is a block diagram illustrating a pair of hearing prostheses and associated bilateral feedback.

FIG. 3B is a block diagram illustrating an example pair of hearing prostheses 350A and 350B and associated bilateral feedback 364A and 364B. The prostheses of FIG. 3B are illustrated as simplified versions of those described with respect to FIG. 1. During operation of the hearing prostheses 350A and 350B, a first vibration-based hearing prosthesis 350A is coupled to one side of a recipient's head and a second vibration-based hearing prosthesis 350B is coupled to the other side of a recipient's head. Hearing prostheses 350A and 350B may also each include a secondary transducer. The secondary transducer may be a different form of transducer than the primary transducer 352A or 352B. For example, primary transducers 352A and 352B may be microphone and secondary transducers may be vibration sensors. Either the primary transducer or the secondary transducer may be used as the input transducer to measure feedback for the methods disclosed herein.

The first hearing prosthesis 350A receives an input signal 360A with its primary transducer 352A. The first hearing prosthesis 350A processes the received signal and creates an output signal 362A (i.e. stimulation) with its output signal interface 355A. Second hearing prosthesis 350B receives an input signal 360B with its primary transducer 352B. The second hearing prosthesis 350B processes the received signal and creates an output signal 362B (i.e. stimulation) with its output signal interface 355B.

A portion of the output signal 362A from the first hearing prosthesis 350A may propagate across a recipient's head as feedback 364A. The feedback 364A will form a portion of the input signal 360B of the second prosthesis 350B. Similarly, a portion of the output signal 362B from the second hearing prosthesis 350B may propagate across a recipient's head as feedback 364B. The feedback 364B will form a portion of the input signal 360A of the first prosthesis 350A. Thus, the output of one prosthesis may form at least a portion of the input to the opposing prosthesis.

Figure 4:
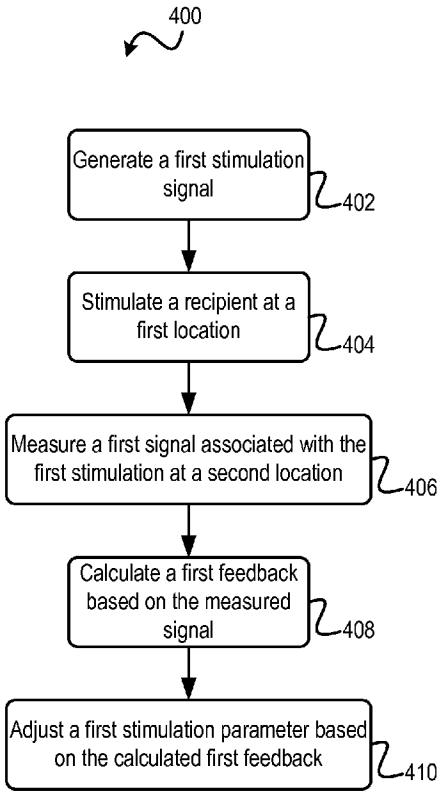
FIG. 4 is a flow diagram illustrating a method for bilateral feedback determination with hearing prostheses.

FIG. 4 is a flow diagram illustrating an example method 400 for bilateral feedback determination with hearing prostheses. The method 400 includes a first hearing prosthesis at a first location generating a stimulation and a second hearing prosthesis at a second location measuring the stimulation. The term "location" as used herein means the general location or region of the respective hearing prosthesis. While a vibration-based prosthesis is physically coupled to a specific point on a recipient's head, the location at which stimulation is measured may be, for example, (i) the point at which the vibration prosthesis is coupled to the recipient or (ii) the general region of the hearing prosthesis. For example, a microphone of the vibration based hearing prosthesis may be considered to be part of the second location where the feedback is measured (and also where the second stimulation is provided).

As part of the method 400, at block 402 a first stimulation signal is generated. The first stimulation signal is the output signal 109 (see FIG. 1) of a hearing prosthesis when it is coupled to a prosthesis recipient. In some embodiments, a computer external to the hearing prosthesis generates the stimulation signal. However, in other embodiments, a processor in the hearing prosthesis, such as the sound processor 104 illustrated in FIG. 1, generates the stimulation signal.

In one embodiment, the stimulation signal is a narrow bandwidth signal, such as a tone, or a wide bandwidth signal, such as a chirp or white noise. In some additional embodiments, the stimulation signal is a plurality of narrowband tones. Because feedback is measured for frequencies that are part of the stimulation signal, it is desirable to include a plurality of frequencies in the stimulation signal. In some embodiments, the stimulation signal is a calibration signal, such as a tone or a wideband signal. In yet other embodiments, the stimulation signal is a speech signal. The speech signal may be either pre-recorded speech or synthesized speech, for example. An audiologist, may determine the particular calibration signal, based on a hearing impairment of a prosthesis recipient. Further, the stimulation signal may be created by the prosthesis based on a signal either (i) created by the prosthesis or (ii) communicated to the prosthesis by an external computing device. For example, the prosthesis may be preprogrammed with a calibration signal that it uses to create a stimulation. However, in other embodiments, an external computing device creates the calibration signal and communicates the calibration signal to the prosthesis. The prosthesis creates a stimulation based on the calibration signal from the external computer.

At block 404, a stimulation is applied to the recipient of the hearing prosthesis. The first hearing prosthesis applies the stimulation at a first location of the recipient. For example, the stimulation is provided near the left ear of the recipient. The method by which the stimulation is applied varies depending on the type of hearing prosthesis used in the specific embodiment. A vibration-based prosthesis uses a stimulator (e.g. output signal interface 105 of FIG. 1) to convert the electrical stimulation signal into a vibration that is conducted to the recipient. In the case of one type of bone conduction prosthesis, the vibration is conducted via an implant to the skull of the prosthesis recipient. However, in other embodiments, a vibration-based hearing prosthesis conducts the vibration through the surface of the skin. For example, if a recipient has a bone-conduction stimulator placed on the surface of his or her head, the bone-conduction stimulator vibrates and conducts the vibration into the skull of the recipient. In yet further embodiments, the recipient has the prosthesis fully implanted within his or her body. The vibrations are conducted to the bones of the recipient's skull from the fully implanted prosthesis.

In another embodiment, the hearing prosthesis is an acoustic hearing aid. In this embodiment, a speaker (or other transducer) converts the electrical stimulation signal to an acoustic wave. The acoustic wave propagates from the speaker and the recipient perceives the acoustic wave as sound. Other types of hearing prostheses may be used as well.

At block 406, a signal associated with the stimulation applied at the first location is measured at a second location of the recipient by the second hearing prosthesis. Because the stimulation is coupled to the recipient at one location and measured at another, this type of feedback is bilateral feedback. For example, the stimulation is provided near the left ear of the recipient (the first location) and the signal associated with the stimulation is measured near the right ear of the recipient (the second location). The first and second locations are regions of the recipient's head, for example. The first location is the region near the left ear (including the hearing prosthesis) and the second location is the region near the right ear (including the hearing prosthesis), according to one example. Alternatively, a stimulation may be provided to another location not proximate to the ear. For example, a recipient may have a bone-conduction prosthesis coupled to the back portion of his or her skull. The method by which the signal associated with the stimulation is measured varies depending on the type of hearing prosthesis used in the specific embodiment.

In some embodiments, a recipient has more than two prostheses. Under such embodiments, in block 406, the feedback from one prosthesis is preferably measured at each additional prosthesis of the recipient. For example, a first prosthesis may be coupled to the rear of the skull of a recipient. This first prosthesis provides a stimulation intended for both the left and right side of the recipient. While stimulations from the first prosthesis will conduct audio that the recipient can perceive on the left and right side, the stimulations from the first prosthesis may also cause feedback with second and third (or more) prostheses.

In another embodiment, there may be more than one hearing prosthesis coupled to a particular location on a recipient. For example, an acoustic hearing aid and a vibration device may be located in the same location (i.e. region) on a recipient. Another hearing prosthesis may be located at a different location. A first prosthesis (of the two prostheses at the same location) provides a first stimulation for the recipient. The prosthesis at the other location measures feedback caused by the first stimulation from the first prosthesis. A second prosthesis (of the two prostheses at the same location) provides a second stimulation for the recipient. The prosthesis at the other location measures feedback caused by the second stimulation from second prosthesis.

In some embodiments, a microphone at the second location measures an audio signal generated by the stimulation at the first location. The hearing prosthesis at the first location creates the audio signal received by the microphone at the second location. In other embodiments, a vibration sensor at the second location measures a vibration signal generated by the stimulation at the first location. The stimulation at the first location is either an acoustic stimulation or a vibration stimulation. The vibration measured at the second location propagates from the first location to the second location via the bones of the recipient's skull. Additionally, in some embodiments, a vibration stimulation causes an audible audio signal to propagate from the first location to the second location other than (or in addition to) via the bones of the recipient's skull. This audible audio signal is also measured as feedback.

In some additional embodiments, block 406 also includes measuring a second signal associated with the stimulation. This second measurement of the signal associated with the stimulation takes place at the first location of the recipient (i.e. the same prosthesis that created the stimulation also measures the second signal). For example, the stimulation is provided near the left ear of the recipient (the first location) and the signal associated with the stimulation is measured near the left ear of the recipient (the first location); thus, unilateral feedback is measured. In this embodiment, a single stimulation provides two feedback signals. The first feedback signal is created by a signal associated with the stimulation propagating from the first location to the second location. The second feedback signal is created by a signal associated with the stimulation at the first location causing feedback at the first location.

At block 408, a first feedback is calculated based on the measured signal associated with the stimulation at the first location. In some embodiments, a computer external to the hearing prosthesis calculates the first feedback. However, in other embodiments, a processor in the hearing prosthesis, such as the sound processor 104 illustrated in FIG. 1, calculates the first feedback.

Feedback may be calculated in a variety of ways, depending on the specific embodiment. Further, in some embodiments, the feedback is calculated differently depending on whether the processor is located in an external computer or in the hearing prosthesis. Because an external computer likely has a more powerful processor and fewer power constraints, the external computer performs more complex feedback calculations. However, in other embodiments, the calculation of feedback is the same regardless of processor location.

In a first example, a processor calculates the feedback by determining that the entire measured signal is a feedback signal. For example, a prosthesis recipient may be located in a clinical setting, such as in an audiologist's office (e.g. an environment that is generally acoustically quiet). In an acoustically quiet environment, any signal received at the second location would be determined to be a feedback signal, according to one embodiment. If other sounds are present near the recipient at the time the measurement is made, these sounds might be measured unintentionally as part of the feedback. Therefore, it is desirable to perform the measurement in a quiet environment. In a preferred embodiment, the processor uses a plurality of measurements, in order to remove a transient background noise from the feedback calculation.

In a second example, a processor calculates the feedback by determining a correlation between the measured signal and the stimulation signal. In this second example, a prosthesis recipient need not be located in a clinical setting. For example, the recipient may be located in his or her home—an environment that is typically not acoustically quiet. By determining a correlation between the measured signal and the stimulation signal, an effect due to environmental noise is mitigated in the feedback measurement. Additionally, some embodiments include using a plurality of measurements to calculate the feedback, in order to remove a transient background noise from the measured signal. For example, a single measurement of feedback may unintentionally capture a background noise. The feedback calculation might otherwise assume that this background noise was a feedback signal. Thus, the feedback calculation would be incorrect, as it assumed a non-feedback sound was feedback. However, by averaging many measurements or removing outlier measurements, background noise may be mitigated from the feedback calculation. A transient background noise would not likely be present for each feedback measurement; thus, as more measurements are made, then a transient background noise's impact on the feedback calculation would be reduced.

At block 410, a first stimulation parameter is adjusted based on the calculated first feedback. In some embodiments, a computer external to the hearing prosthesis device adjusts the stimulation parameter to reduce the first feedback. However, in other embodiments, a processor in the hearing prosthesis, such as the sound processor 104 illustrated in FIG. 1, adjusts the stimulation parameter to reduce the first feedback.

As discussed above, a gain table associated with the hearing prosthesis system may include both a maximum allowable gain and a prescribed gain. The maximum allowable gain corresponds to an overall system gain. For example, the maximum allowable gain may be based on a specific set of prosthesis hardware. In one example, the maximum allowable gain ensures that the prosthesis hardware operates within tolerances. Typically, feedback problems limit the maximum gain for a given prosthesis. The maximum gain can also be limited by maximal supported digital gain in the digital signal processor (DSP). The maximal supported digital gain is defined by the dynamic range between the noise floor and saturation level of the DSP. The maximum gain can also be limited by the difference between an amplitude of an incoming signal and the saturation level (e.g. the maximum output of the device). In some examples, the noise floor generated by the signal processing in the DSP can also limit the maximum gain. The maximum gain can also be limited due to the intended indication range of the device (e.g. what hearing loss the device is designed for). In such an example, the designed maximum gain may limit the maximum allowable gain (i.e. maximum output), for example, for safety reasons.

The prescribed gain corresponds to a gain associated with a specific prosthesis recipient. In some embodiments, the prescribed gain is based on a hearing impairment of the prosthesis recipient. The prescribed gain specifies a gain for each band in a plurality of frequency bands. In one example, if the feedback is contained within a specific frequency band, the processor adjusts the gain table to reduce gain on the corresponding frequency band. Thus, the processor amplifies by a lesser amount (or even does not amplify at all) the frequencies that suffer from feedback. Depending on particular desired application, the processor adjusts either the maximum allowable gain or the prescribed gain in response to determining feedback.

In other embodiments, alternative methods are used either in place of, or combined with, adjusting the gain table in order to reduce feedback. In one example, adjusting the stimulation parameter includes adjusting a pre-filtering frequency response of a feedback reduction algorithm. The feedback reduction algorithm may be configured to reduce both static and dynamic feedback. The feedback reduction algorithm reduces static feedback based at least in part on the bilateral feedback measurements disclosed herein. Filter coefficients for the feedback reduction algorithm come from a least mean square (LMS) calculation of the measured bilateral feedback. In some embodiments, the LMS calculation is performed on the worst-case feedback within each respective frequency band. In various embodiments, the LMS calculation may be performed in either the time domain or the frequency domain. Further, the LMS calculation may also be performed on any feedback (e.g. not just the worst-case feedback). Additionally, in some embodiments, adjusting the stimulation parameter includes setting a latency and/or group delay estimate of the feedback reference signal used by a feedback reduction algorithm. Once feedback is identified, other suitable types of feedback reduction may be used as well.

After block 410, method 400 may be repeated with the second hearing prosthesis. The second hearing prosthesis generates the stimulation signal (i.e. acts as the first location) and the feedback signal is measured at the first prosthesis (i.e. acts as the second location). By repeating the process with both prostheses, the bilateral feedback is calculated for each prosthesis that provides a stimulation. Therefore, the feedback is measured at each prosthesis when the alternate prosthesis creates a stimulation. Additionally, in some embodiments, each prosthesis measures local feedback (unilateral feedback) as well. In yet further embodiments, both prostheses provide stimulations at the same time. Thus, in this embodiment, all feedback measurements are made substantially simultaneously.

Figure 5:
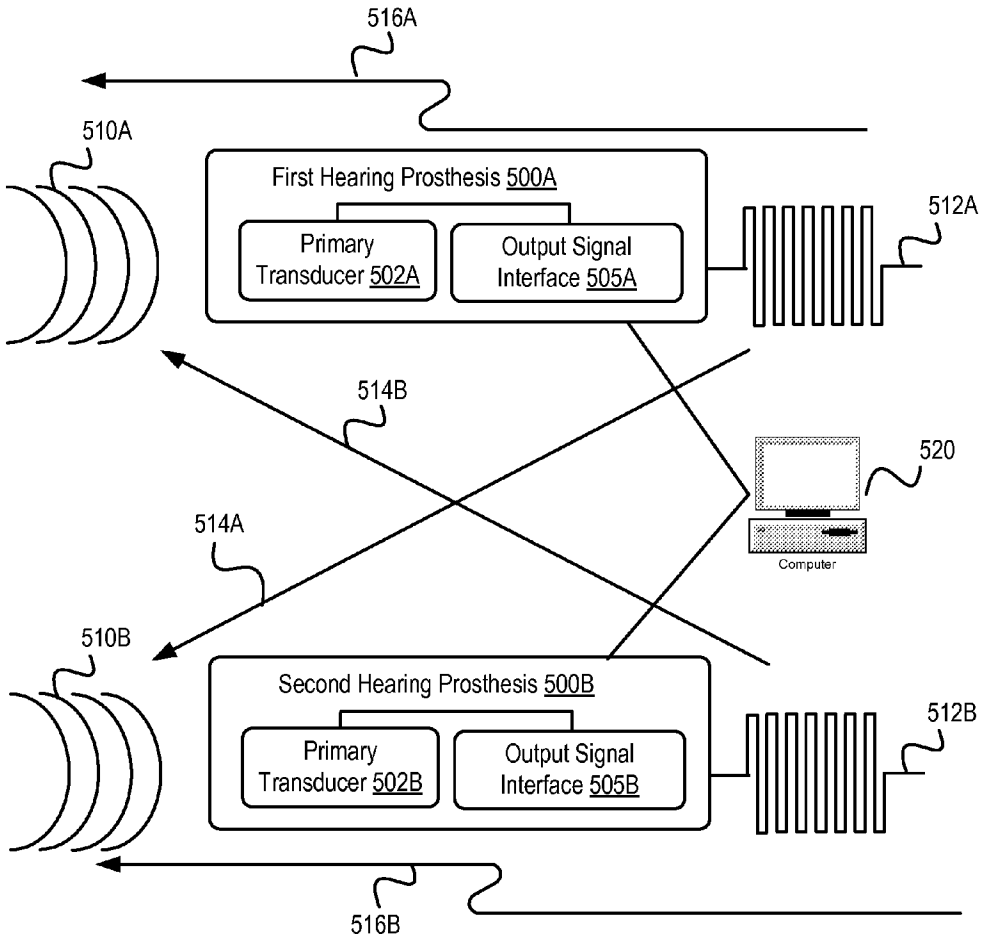
FIG. 5 is a block diagram illustrating a pair of hearing prostheses coupled to a computer.

FIG. 5 is a block diagram illustrating an example pair of hearing prostheses 500A and 500B coupled to a computer 520. The prostheses 500A and 500B of FIG. 5 are similar to those described with respect to FIG. 1 and are intended, during normal operation, to allow a recipient to perceive sound signals 510A and 510B. The computer 520 is used in some embodiments for programming and calibrating the hearing prostheses 500A and 500B. The computer 520 communicates with prostheses 500A and 500B over a wired or wireless connection, for example.

In one embodiment, the computer 520 causes output signal interface 505A of first hearing prosthesis 500A to output an output signal 512A based on a calibration signal. The computer 520 may provide the calibration signal or it may be preprogrammed in the first hearing prosthesis 500A. When the output signal 512A is conducted to the recipient, it also creates feedback signal 514A. Feedback signal 514A is captured in part by primary transducer 502B of the second hearing prosthesis 500B. The signal captured by the primary transducer 502B is communicated back to the computer 520 for processing as feedback.

Additionally, the primary transducer 502A of the first hearing prosthesis 500A captures some of the output signal 512A that is communicated via unilateral feedback path 516A. The first hearing prosthesis 500A may also provide information for processing about the unilateral feedback to the computer 520.

Similarly, the computer 520 causes the output signal interface 505B of second hearing prosthesis 500B to output an output signal 512B based on a calibration signal. The computer 520 may provide the calibration signal or it may be preprogrammed in the second hearing prosthesis 500B. In some embodiments, both hearing prostheses 500A and 500B use the same calibration signal. However, in some embodiments, hearing prostheses 500A and 500B may each use a different calibration signal. When the output signal 512B is conducted to the recipient, it also creates feedback signal 514B. Feedback signal 514B is captured in part by primary transducer 502A of the first hearing prosthesis 500A. The signal captured by primary transducer 502A is communicated back to computer 520 for processing as feedback.

Additionally, the primary transducer 502B of the second hearing prosthesis 500B captures some of the output signal 512B that is communicated via unilateral feedback path 516B. The second hearing prosthesis 500B may also provide information for processing about the unilateral feedback to the computer 520.

In yet further embodiments, the computer 520 causes the output signal interface 505A of the first hearing prosthesis 500A and the output signal interface 505B of the second hearing prosthesis 500B to each output a respective output signal 512A and 512B based on respective calibration signals. The computer 520 may provide the calibration signal or it may be preprogrammed in each hearing prosthesis. When the output signals 512A and 512B are conducted to the recipient, feedback signals 514A and 514B are created.

Each feedback signal 514A and 514B is captured in part by the primary transducer 502B and 502A of the opposing hearing prosthesis 500B and 500A. The signal captured by the primary transducers 502A and 502B is communicated back to the computer 520 for processing as feedback. Additionally, each unilateral feedback signal 516A and 516B is captured in part by the primary transducer 502A and 502B of the same respective hearing prosthesis 500A and 500B. The unilateral feedback signals 516A and 516B are captured by the respective primary transducers 502A and 502B and are communicated back to the computer 520 for processing as feedback.

In some embodiments, computer 520 displays representations of some or all of the feedback signals 514A and 514B and unilateral feedback signals 516A and 516B. Based on the displayed feedback representations, different parameters of the hearing prostheses may be adjusted. Further, a visual display of both bilateral and unilateral feedback may allow parameters to be adjusted more precisely.

When both hearing prostheses 502A and 502B are providing a calibration stimulation simultaneously, it may be advantageous to have each respective prosthesis making a different calibration stimulation (e.g. at a different frequency). If each calibration stimulation is different, the computer 520 is able to identify the difference between unilateral and bilateral feedback in its feedback reduction processing.

While various aspects and embodiments have been disclosed herein, other aspects and embodiments will be apparent to those skilled in the art. The various aspects and embodiments disclosed herein are for purposes of illustration and are not intended to be limiting, with the true scope being indicated by the following claims.

What is claimed is:

1. A method, comprising:

generating, by a processor, a first stimulation signal using a first gain parameter;

delivering a first vibration to a first location of a recipient's head, wherein the first vibration is based on the first stimulation signal and is configured to evoke a hearing percept at a first ear of the recipient;

measuring a first signal at a second location on the recipient's head;

calculating a first feedback component based on the measured first signal, wherein the first feedback component comprises a portion of the first vibration conducted through the recipient's head from the first location to the second location; and adjusting a first gain parameter based on the first feedback component to decrease the portion of the first vibration that is conducted through the recipient's head from the first location to the second location, wherein the first gain parameter is defined as part of a gain table specifying a plurality of gains for use in generating stimulation signals, wherein the plurality of gains are each used to generate stimulation signals within a corresponding frequency band.

2. The method of claim 1, wherein adjusting the first gain parameter based on the first feedback component to decrease the portion of the first vibration that is conducted through the recipient's head from the first location to the second location comprises:

determining at least one frequency associated with the first feedback component; and adjusting, in the gain table, a gain parameter that is associated only with the at least one frequency.

3. The method of claim 2, wherein adjusting, in the gain table, a gain parameter that is associated only with the at least one frequency comprises:

adjusting a maximum allowable gain associated with the at least one frequency.

4. The method of claim 2, wherein adjusting, in the gain table, a gain parameter that is associated only with the at least one frequency comprises:

adjusting a prescribed gain associated with the at least one frequency.

5. The method of claim 1, further comprising:

measuring at the first location on the recipient's head a first unilateral signal; and calculating a first unilateral feedback component based on the first unilateral signal, wherein the first unilateral feedback component comprises a portion of the first vibration, and wherein adjusting the first gain parameter is further based on the first unilateral feedback component.

6. The method of claim 5, further comprising:

measuring at the second location on the recipient's head a second unilateral signal; and calculating a second unilateral feedback component based on the second unilateral signal, wherein the second unilateral feedback component comprises a portion of the second vibration.

7. The method of claim 1, wherein calculating the first feedback component comprises:

correlating the first signal with the first stimulation signal to identify background noise.

8. The method of claim 7, wherein adjusting the first gain parameter based on the first feedback component to decrease the portion of the first vibration that is conducted through the recipient's head from the first location to the second location comprises:

adjusting the first gain parameter based on the identified background noise.

9. The method of claim 1, further comprising:

at the second location on the recipient's head, measuring a plurality of signals each associated with a vibration delivered to a first location of a recipient's head, wherein calculating the first feedback component comprises:

identifying, from the plurality of measurements, transient noise; and calculating the first feedback component to remove the identified transient background noise.

10. A hearing prosthesis system comprising:

a first prosthesis coupled to a first location on a recipient's head, wherein the first prosthesis comprises a first input transducer and a first electromechanical stimulator;

a second prosthesis coupled to a second location on the recipient's head, wherein the second prosthesis comprises a second input transducer and a second electromechanical stimulator, and wherein the first location and the second location are on opposite sides of the recipient's head; and at least one processor communicably coupled to at least one of the first prosthesis and the second prosthesis, wherein the at least one processor is configured to:

send a first stimulation signal to the first prosthesis, thereby causing the first prosthesis to deliver a first vibration that is based on the first stimulation signal;

receive, from the second prosthesis, an indication of a first signal detected by the second input transducer;

calculate, based on the indication of the first signal, a first feedback signal as a part of the first signal that is comprised of a portion of the first vibration conducted through the recipient's head from the first location to the second location by correlating the first signal with the first stimulation signal to identify background noise; and adjust, based on the first feedback signal, at least one gain parameter for subsequent use at the first prosthesis.

11. The hearing prosthesis system of claim 10, wherein the at least one processor is further configured to:

receive an indication of a second signal detected at the first input transducer of the first prosthesis, calculate, based on the indication of the second signal, a second feedback signal as a part of the second signal that is comprised of a portion of the first vibration; and adjust, based on the second feedback signal, at least one gain parameter for subsequent use at the second prosthesis.

12. The hearing prosthesis system of claim 10, wherein the at least one processor is further configured to:

communicate a second stimulation signal to the second prosthesis, thereby causing the second prosthesis deliver a second vibration that is based on the second stimulation signal;

receive, from the first prosthesis, an indication of a third signal detected by the first input transducer;

calculate, based on the indication of the third signal, a third feedback signal as a part of the third signal that is comprised of a portion of the second vibration conducted through the recipient's head from the second location to the first location; and adjust, based on the third feedback signal, the at least one gain parameter for subsequent use at the first prosthesis.

13. The hearing prosthesis system of claim 12, wherein the at least one processor is further configured to:

receive an indication of a fourth signal detected at the second input transducer of the second prosthesis;

calculate, based on the indication of the fourth signal, a fourth feedback signal as a part of the fourth signal that is comprised of a portion of the second vibration; and adjust, based on the fourth feedback signal, the at least one gain parameter for subsequent use at the second prosthesis.

14. The hearing prosthesis system of claim 10, wherein the at least one gain is defined as part of a gain table specifying a plurality of gains for use in generating stimulation signals at the first prosthesis, wherein the plurality of gains are each used to generate stimulation signals within a corresponding frequency band, and wherein to adjust, based on the first feedback signal, at least one gain parameter for subsequent use at the first prosthesis, the processor is configured to:

determine at least one frequency associated with the first feedback component; and adjust, in the gain table, a gain parameter that is associated only with the at least one frequency.

15. The hearing prosthesis system of claim 14, wherein adjusting, in the gain table, a gain parameter that is associated only with the at least one frequency comprises:

adjusting a maximum allowable gain associated with the at least one frequency.

16. The hearing prosthesis system of claim 14, wherein adjusting, in the gain table, a gain parameter that is associated only with the at least one frequency comprises:

adjusting a prescribed gain associated with the at least one frequency.

17. The hearing prosthesis system of claim 14, wherein to adjust, based on the first feedback signal, at least one gain parameter for subsequent use at the first prosthesis, the processor is configured to: adjust the first gain parameter based on the identified background noise.

18. A method, comprising:

generating, by a processor, a first stimulation signal using a first gain parameter;

delivering a first vibration to a first location of a recipient's head, wherein the first vibration is based on the first stimulation signal and is configured to evoke a hearing percept at a first ear of the recipient;

measuring a first signal at a second location on the recipient's head;

calculating a first feedback component based on the measured first signal, wherein the first feedback component comprises a portion of the first vibration conducted through the recipient's head from the first location to the second location;

adjusting a first gain parameter based on the first feedback component to decrease the portion of the first vibration that is conducted through the recipient's head from the first location to the second location; and measuring, at the second location on the recipient's head, a plurality of signals each associated with a vibration delivered to the first location of a recipient's head, wherein calculating the first feedback component comprises:

identifying, from the plurality of measurements, transient noise; and calculating the first feedback component to remove the identified transient background noise.

19. The method of claim 18, wherein the first gain parameter is defined as part of a gain table specifying a plurality of gains for use in generating stimulation signals, wherein the plurality of gains are each used to generate stimulation signals within a corresponding frequency band.

20. The method of claim 19, wherein adjusting the first gain parameter based on the first feedback component to decrease the portion of the first vibration that is conducted through the recipient's head from the first location to the second location comprises:

determining at least one frequency associated with the first feedback component; and adjusting, in the gain table, a gain parameter that is associated only with the at least one frequency.

* * * * *